United States Patent [19]

Münch

[11] Patent Number: 4,468,176

[45] Date of Patent: Aug. 28, 1984

[54] TURBINE DRIVEN PUMP

[75] Inventor: Helmut Münch, Frankenthal, Fed. Rep. of Germany

[73] Assignee: Klein, Schanzlin & Becker Aktiengesellschaft, Frankenthal(Pfalz), Fed. Rep. of Germany

[21] Appl. No.: 545,118

[22] Filed: Oct. 25, 1983

Related U.S. Application Data

[63] Continuation of Ser. No. 275,255, Jun. 19, 1981.

[30] Foreign Application Priority Data

Jun. 21, 1980 [DE] Fed. Rep. of Germany ..... 3023219

[51] Int. Cl.[3] ..... F04B 17/00

[52] U.S. Cl. ..... 417/406; 415/104; 415/144

[58] Field of Search ..... 417/405, 406, 407, 408, 417/409; 415/104, 105, 106, 107, 144

[56] References Cited

U.S. PATENT DOCUMENTS

| | | | |
|---|---|---|---|
| 1,110,864 | 9/1914 | Banner | 417/409 |
| 1,499,056 | 6/1924 | Hollander | 415/104 |
| 1,609,306 | 12/1926 | Peterson | 417/406 |
| 2,216,494 | 10/1940 | Kurtz et al. | 60/39.75 |
| 2,283,176 | 5/1942 | Birmann | 417/406 |
| 4,120,156 | 10/1978 | McInerney | 415/144 |
| 4,255,095 | 3/1981 | Goulvestre et al. | 417/406 |

FOREIGN PATENT DOCUMENTS

| | | | |
|---|---|---|---|
| 655698 | 12/1937 | Fed. Rep. of Germany | 417/408 |

*Primary Examiner*—Carlton R. Croyle
*Assistant Examiner*—Jeffrey A. Simenauer
*Attorney, Agent, or Firm*—Peter K. Kontler

[57] ABSTRACT

A turbine driven pump wherein a multi-stage centrifugal pump unit is coaxial with and mounted on a common shaft with a turbine unit. The two units are connected to each other by a low-pressure section which defines a hydrostatic seal between the interior of the pump unit and the interior of the turbine unit. The inlet and outlet of the turbine unit are connected with each other by a conduit containing a regulating valve, and the inlet of the pump unit is connected with chambers at the outer sides of relief pistons disposed at the high-pressure sides of the two units. The diameters of the relief pistons are proportional to pressures in the high-pressure portions of the respective units. The inlet of the pump unit is coaxial with the outlet of the turbine unit.

8 Claims, 2 Drawing Figures

TURBINE DRIVEN PUMP

This application is a continuation of application Ser. No. 275,255, filed June 19, 1981.

BACKGROUND OF THE INVENTION

The present invention relates to improvements in turbine driven pumps, and more particularly to improvements in turbine driven pumps wherein not only the pump unit but also the turbine unit comprises a discrete inlet and outlet and wherein the two units have a common shaft.

It is already known to utilize turbine driven pumps in large pumping aggregates and to couple the pump wheel as well as the turbine wheel to a common train of shafts. Such large aggregates can be used to pump a liquid into one or more containers during the intervals of idleness of a plant (e.g., at night) so as to accumulate a requisite supply of liquid (e.g. water) for the next shift or shifts. It is also known to utilize in a turbine driven pump a multi-stage centrifugal pump unit whose radial stages can operate not unlike a turbine. The pumping unit and the turbine unit are mounted on a common shaft. Such aggregates are used primarily in washing and cleaning establishments wherein the fluid must be subjected to an elevated pressure while, at the same time, the pressure of waste fluid in the circuit must be reduced to a relatively low value. A portion of fluid can be diverted from the pump circuit and utilized, at a reduced pressure, in the turbine unit. In order to circulate the entire body of fluid, it is necessary to ensure that the pump unit will furnish fluid at the required pressure. The diversion of a certain amount of fluid and other losses which invariably arise when the aggregate is in use necessitate the consumption of additional energy which is normally supplied by an electric motor or another suitable prime mover. The connection between the motor and the aggregate includes a clutch. An important feature of the just outlined prior aggregates is that the supplied energy which is necessary for ensuring circulation of fluid but is not needed for the product stream can be recovered directly as driven energy.

European patent application Ser. No. 0 008 260 discloses a turbine driven pump wherein the high-pressure side of the pump unit is adjacent to and is coupled with the high-pressure side of the turbine unit. Such countercurrent arrangement serves to compensate for axial forces in the pump and turbine units. A drawback of this turbine driven pump is that it must embody a costly intermediate section which should stand elevated pressures.

OBJECTS AND SUMMARY OF THE INVENTION

An object of the invention is to provide a novel and improved turbine driven pump which is simpler, less expensive and more reliable than heretofore known turbine driven pumps.

Another object of the invention is to provide a turbine driven pump wherein the intermediate or central section which is disposed between the pump unit and the turbine unit is simpler, less expensive and more compact than in heretofore known turbine driven pumps.

A further object of the invention is to provide a turbine driven pump which, even though utilizing a relatively simple and inexpensive intermediate section, allows for complete compensation of axial forces.

An additional object of the invention is to provide a turbine driven pump wherein the orientation of the turbine unit with reference to the pump unit is more satisfactory than in heretofore known turbine driven pumps.

Still another object of the invention is to provide the turbine driven pump with novel and improved means to compensate for or counteract axial forces in the pump unit as well as in the turbine unit.

A further object of the invention is to provide a turbine driven pump which can be utilized as a superior substitute for heretofore known turbine driven pumps in large pumping plants, washing or cleaning plants and/or other establishments.

The invention is embodied in a turbine driven pump which comprises a centrifugal pump unit having an inlet and an outlet, a turbine unit having an inlet and an outlet, a common shaft for the two units, and a low-pressure section disposed between, common to and coupling the two units with one another.

Each of the two units has a high-pressure portion or zone, and the turbine driven pump preferably further comprises a relief piston or plunger in each of the high-pressure portions. The magnitude of axial stresses upon the pump unit in the high-pressure portion thereof may deviate from the magnitude of axial stresses upon the turbine unit in the high-pressure portion of the turbine unit. The ratio of diameters of the plungers is then proportional to the ratio of axial stresses in the regions of high-pressure portions of the two units.

The turbine driven pump preferably further comprises means (e.g., one or more hoses, pipes or other types of conduits) for connecting the high-pressure portion and the low-pressure portion of the turbine unit, and valve means or another suitable device for regulating the flow of fluid between the high-pressure and low-pressure portions of the turbine unit.

The inlet of the pump unit and the outlet of the turbine unit are preferably located in the region of the low-pressure portion of the turbine unit, and the inlet of the pump unit is preferably coaxial with the outlet of the turbine unit.

The novel features which are considered as characteristic of the invention are set forth in particular in the appended claims. The improved turbine driven pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1A:
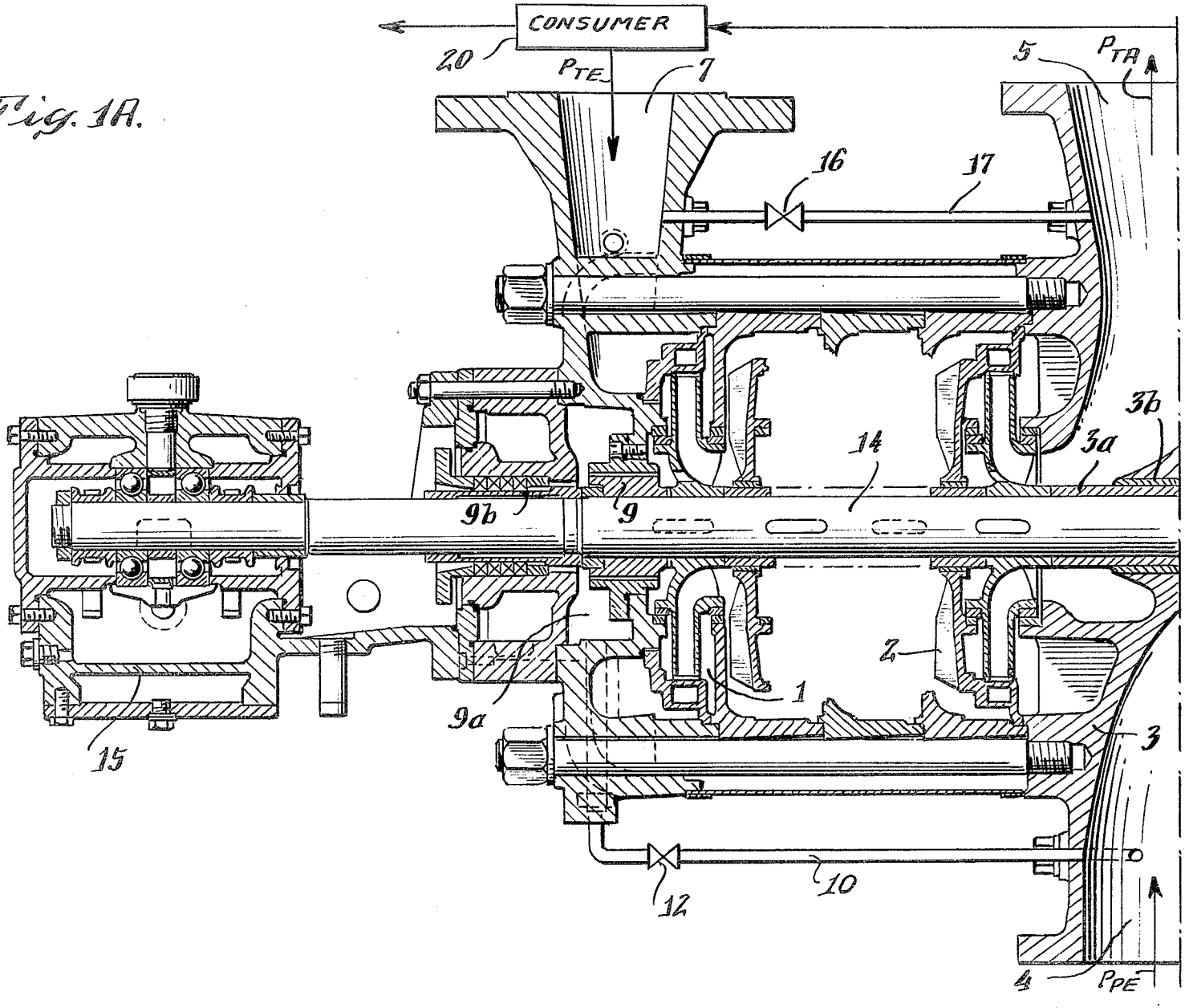
FIG. 1A is a somewhat schematic axial sectional view of a portion of a turbine pump constructed and assembled in accordance with the subject invention.
Figure 1B:
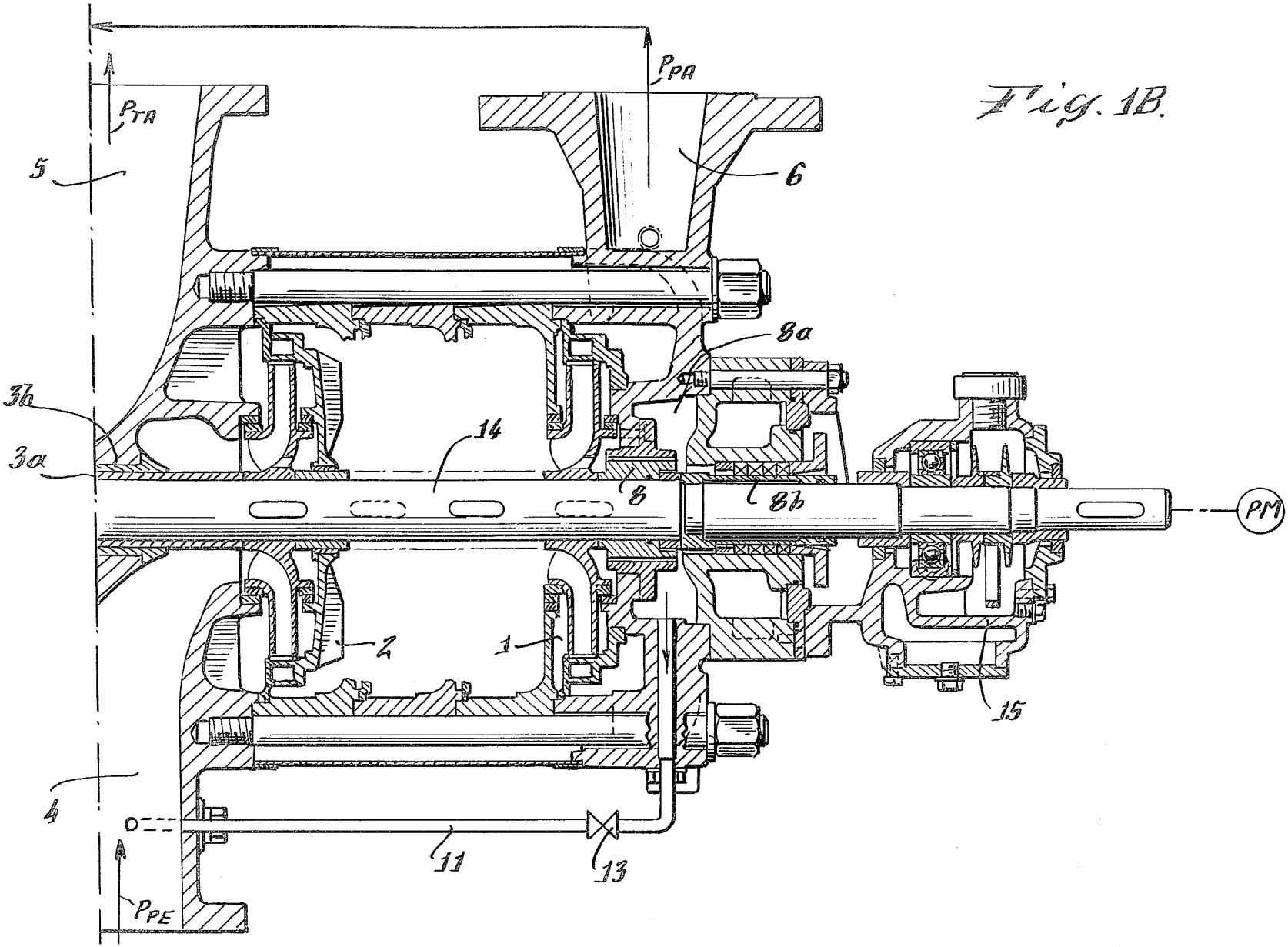
FIG. 1B is a somewhat schematic axial sectional view of the other portion of the turbine driven pump of FIG. 1A.

The turbine driven pump which is shown in FIGS. 1A and 1B comprises a turbine unit 2 and a centrifugal multi-stage pump unit 1. These units have a common shaft 14 and are coupled to each other by an intermediate section 3 which includes the inlet 4 of the centrifugal pump unit 1 and the outlet 5 of the turbine unit 2 and which is designed to withstand relatively low pressures. The pump unit 1 further includes an outlet 6 and the turbine unit 2 includes an inlet 7.

The high-pressure portions or zones of the units 1 and 2 contain the corresponding devices for counteracting or compensating for axial forces. Thus, the pump unit 1 includes a relief piston or plunger 8, and the turbine unit 2 includes a relief piston or plunger 9. The turbine driven pump further includes relief conduits 10, 11 with flow restrictors 12 and 13, respectively. The conduits 10, 11 connect the inlet 4 with the chambers 9*a*, 8*a* respectively surrounding the plungers 9, 8.

The shaft seals for the common shaft 14 are of conventional design and, therefore, they are not specifically shown in the drawing. The end portions of the shaft 14 are journalled in roller bearings 15.

The high-pressure and the low-pressure portions or zones of the turbine unit 2 are connected with each other by a conduit 17 containing a regulating device 16, such as a valve or a flow restrictor.

The process fluid enters the turbine driven pump by way of the inlet 4 of the pump unit 1 at a pressure $P_{PE}$. Such fluid is pressurized during flow through the stages of the pump unit 1 and issues at the outlet 6 at a pressure $P_{PA}$. That portion or percentage of pressurized fluid which is not needed for the process (note the consumer 20) is admitted into the high-pressure portion of the turbine unit 2 (at a pressure $P_{TE}$ which is lower than the pressure $P_{PA}$ by a value determined by losses of fluid) via inlet 7 and passes through the turbine unit 2 to issue at the outlet 5 at a pressure $P_{TA}$. The energy which is supplied by fluid flowing through the turbine unit 1 is transmitted directly to the pump unit 1 by way of the common shaft 14. That percentage of energy which is taken up by the utilized process stream and which is taken up as a result of frictional losses is supplied by a suitable drive PM, e.g., an electric motor.

Fluid at a pressure corresponding to the pressure difference $P_{PE}-P_{TA}$ between the inlet 4 of the pump unit 1 and the outlet 5 of the turbine unit 2 is applied to a rigid throttle 3*a*, 3*b* which separates the pump unit 1 from the turbine unit 2. This ensures the establishment of an additional (hydrostatic) bearing (the parts 3*a* and 3*b* may constitute cylindrical sleeves surrounding the shaft 14 within the confines of the section 3 and the additional bearing may constitute a narrow annular clearance between such sleeves) in the section as well as in all other seals within the entire turbine driven pump. In view of the difference between the pressures which prevail in the turbine unit 2 and pump unit 1, the shaft 14 is subjected to axial forces and such axial forces are compensated for by the relief piston or plunger 8 of the pump unit 1 and the relief piston or plunger 9 of the turbine unit 2. Since the pistons 8 and 9 are disposed at the readily accessible ends of the turbine driven pump, they can be reached by the simple expedient of removing or dismantling the respective bearings 15. This enables the attendants to replace the piston 8 and/or 9 with little loss in time, e.g., in the event of excessive wear. The diameters of the pistons 8 and 9 can be different to thus account and compensate for different pressures, i.e., to allow the turbine driven pump to conform to different pressures. This contributes to versatility of the improved turbine driven pump, i.e., such pump can be used in systems wherein the pressure differential between the fluids in the turbine unit and the pump unit is relatively small, or medium value or very pronounced.

By appropriate selection of flow restrictors 12 and 13 in the respective conduits 10 and 11, one can select the pressure in the regions adjacent to the shaft seals in such a way that the liquid can be relieved of gases. This reduces problems at and with the seals. The optimum efficiency of the turbine unit 2 can be selected by appropriate adjustment of the rate of bypass flow via conduit 17 and regulating means 16 in dependency on the ratio of useful fluid to total fluid.

An important advantage of the improved turbine driven pump is that the section 3 is disposed between the low-pressure portions of the units 1 and 2. Therefore, and owing to the relatively low difference between the pressures in the adjacent portions of the units 1 and 2, separation of such units in the region of the inlet 4 and outlet 5 presents no problems. Moreover, losses of fluid in the region of the intermediate section 3 are low or negligible. Since the section 3 must be designed to stand relatively low pressures, it can be manufactured, assembled and installed at a relatively low cost.

Another important advantage of the improved turbine driven pump is that the pistons 8 and 9 can effect a complete balancing or neutralization of axial stresses which develop as a result of differences between the pressure of liquid in the turbine unit 2 and the pressure of liquid in the pump unit 1. Such pistons are installed in the high-pressure portions of the respective units and, as stated above, their diameters can be selected with a view to account for different axial forces. This renders it possible to mount the shaft 14 in simple roller bearings 15 with minimal leakage of fluid. Thus, the roller bearings 15 need not be designed to stand pronounced axial stresses because such stresses are compensated for by the pistons or plungers 8 and 9. In other words, were the plungers 8 and 9 omitted, the bearings 15 would have to be replaced by sturdier and more complex friction or other bearings.

The relief streams of fluid which flow along the relief pistons 8, 9 can be utilized for the purpose of regulating the operation of the turbine driven pump, namely, to conform the characteristics of the turbine unit 2 to the characteristics of the pump unit 1. Since the absorption capacity of multi-stage pumps which operate as turbines cannot be regulated, optimal conformance of the operating points of pump unit 1 and turbine unit 2 is desirable and necessary; this can be readily achieved by appropriate adjustment of the regulating device 16 in the conduit 17.

An additional advantage of the improved turbine driven pump is that the outlet 5 of the turbine unit 2 is coaxial with the inlet 4 of the pump unit 1. This contributes to balancing of stresses upon the component parts of the turbine driven pump. Moreover, the conduits which are connected to the inlet 4 and outlet 5 can be coaxial with each other which is desirable and advantageous in many types of installations. It will be noted that the low-pressure portions of the units 1, 2 are adjacent to and that the high-pressure portions of these units are distant from one another.

It can be said that the section 3 constitutes a rigid seal between the units 1 and 2 by permitting a relatively small quantity of fluid to flow between the sleeves 3*a* and 3*b*. As mentioned above, the difference between the pressures at the opposite axial ends of the section 3 is not high so that the leakage between the sleeves 3*a* and 3*b* is minimal.

The chambers 8*a* and 9*a* are sealed by shaft seals 8*b* and 9*b* which are located at the outer sides of the relief pistons 8 and 9. As mentioned above, the chambers 8*a* and 9*a* are connected with the inlet 4 by the respective conduits 11 and 10.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a turbine driven pump, the combination of a liquid pump unit having an inlet and an outlet; a liquid turbine unit having an inlet and an outlet; a common shaft for said units; and an intermediate section adapted to withstand relatively low pressures disposed between, common to and coupling said units, wherein said units each include a portion adapted to withstand relatively high pressures and a relief plunger surrounding said shaft in this respective high-pressure portion and wherein the inlet for said pump unit and the outlet for said turbine unit are disposed in the intermediate portion.

2. The combination of claim 1, wherein said plungers each have a diameter preselected to compensate for different axial forces which develop as a result of different pressures of fluid in the respective high-pressure portions.

3. The combination of claim 1, wherein axial stresses upon the pump unit in the high-pressure portion thereof deviate from axial stresses upon the turbine unit in the high-pressure portion of the turbine unit, the ratio of diameters of said plungers being proportional to the ratio of axial stresses in the regions of high-pressure portions of the respective units.

4. The combination of claim 1, further comprising means for connecting portions of said turbine unit with one another.

5. The combination of claim 4, further comprising means for regulating the flow of fluid in said connecting means.

6. The combination of claim 1, wherein the inlet of said pump unit is coaxial with the outlet of said turbine unit.

7. The combination of claim 1, wherein said intermediate section includes means defining a narrow clearance establishing communication between units adjacent said shaft.

8. The combination of claim 1, wherein said pump unit is a multi-stage centrifugal pump unit, said shaft having end portions and further comprising roller bearings for the end portions of said shaft.

* * * * *